United States Patent [19]

Wilson et al.

[11] Patent Number: 4,734,826

[45] Date of Patent: Mar. 29, 1988

[54] WORK SURFACE WITH CHANNEL FOR POWER COMMUNICATION CABLING

[75] Inventors: Harold R. Wilson, Holland; Allen B. Belka, Wayland, both of Mich.

[73] Assignee: Haworth, Inc., Holland, Mich.

[21] Appl. No.: 59,150

[22] Filed: Jun. 5, 1987

Related U.S. Application Data

[63] Continuation of Ser. No. 837,909, Mar. 10, 1986, abandoned.

[51] Int. Cl.[4] ..... H02B 1/20

[52] U.S. Cl. ..... 361/428; 312/223

[58] Field of Search ..... 312/223; 361/428

[56] References Cited

U.S. PATENT DOCUMENTS

| | | | |
|---|---|---|---|
| 2,306,209 | 12/1942 | Elofson et al. | 312/208 |
| 3,373,703 | 3/1968 | Barecki | 108/50 |
| 3,635,174 | 1/1972 | Ball | 108/50 |
| 3,783,175 | 1/1974 | Timmons | 174/48 |
| 3,883,202 | 5/1975 | Konig | 312/223 |
| 4,094,256 | 6/1978 | Holper | 108/50 |
| 4,296,981 | 10/1981 | Hildebrandt et al. | 312/194 |
| 4,323,291 | 4/1982 | Ball | 312/194 |
| 4,372,629 | 2/1983 | Propst et al. | 312/223 |
| 4,377,724 | 3/1983 | Wilson | 174/48 |
| 4,654,756 | 3/1987 | Wilson et al. | 361/428 |

FOREIGN PATENT DOCUMENTS

| | | |
|---|---|---|
| 0006707A1 | 1/1980 | European Pat. Off. . |
| 0010277A1 | 4/1980 | European Pat. Off. . |

*Primary Examiner*—A. D. Pellinen
*Assistant Examiner*—Morris Ginsburg
*Attorney, Agent, or Firm*—Flynn, Thiel, Boutell & Tanis

[57] ABSTRACT

A work surface structure having a channel arrangement fixed to and extending longitudinally along a front edge of a top member for accommodating power/communication cables. The channel arrangement has a bottom wall provided with openings which accommodate removable tray modules. One of the tray modules can be of substantial depth to mount a power unit therein which provides a plurality of accessible receptacles. Access to the trays is through the channel, the latter having several openable covers. These covers are preferably hinged adjacent their rearward edges and, in the vicinity of their forward edges when in the closed position, there is defined an elongated access opening which communicates with the channel to permit power or communication cables to extend therethrough.

11 Claims, 4 Drawing Figures

WORK SURFACE WITH CHANNEL FOR POWER COMMUNICATION CABLING

This application is a continuation of U.S. Ser. No. 837,909, filed Mar. 10, 1986, now abandoned.

FIELD OF THE INVENTION

This invention relates to a work surface structure, such as for a table or for mounting on a wall panel, which work surface structure has an openable channel associated therewith for power and communication cabling. The channel having removable modular trays, with one of the trays having a power block associated therewith.

BACKGROUND OF THE INVENTION

The modern office environment is using increasing numbers of electronic equipment which are increasing the demands for both electrical and communication cabling. These demands, coupled with the extensive use of open-office systems employing portable space-divider panels, have greatly complicated the ability to provide power and communication cabling to desired locations without creating unsightly clusters of visible cables.

In an attempt to resolve this problem, there has been developed a work surface having a power block associated therewith, which surface is suitable for use on a table or wall panel, and is disclosed in copending application Ser. No. 699 117 filed Feb. 7, 1985, now U.S. Pat. No. 4,654,756, which is Applicants' own prior development. The disclosure of this latter application is incorporated herein, in its entirety, by reference.

In an attempt to continue to improve on such arrangements, the present invention has been developed and this again relates to a work surface arrangement suitable for mounting on a table or a wall. The work surface arrangement has a channel structure extending along the rear edge thereof, which channel is accessible through a plurality of sidewardly disposed doors. The doors are preferably hinged adjacent their forward edges to swing forwardly toward the user to provide access to the channel. The doors, when closed, define an elongated access opening along the free edges thereof for permitting cables to extend therethrough into the interior of the channel, whereby the cables can connect to equipment located on the work surface.

In an embodiment of the channel structure has a bottom wall provided with at least two longitudinally spaced openings in the preferred embodiment, which openings readily mount therein removable modular trays. These trays each are of a generally channel-like configuration which enables them to be removably positioned in the opening due to the trays having flanges which rest on the bottom wall of the channel arrangement, whereby the trays can be readily mounted on or removed and interchanged. The one tray is of a shallow channel-like cross section to provide extra space for storage of cables. The other tray, in a typical use environment, is of significant depth and mounts thereon a power block having several electrical receptacles and/or cabling ports associated therewith, the power block also typically having surge protectors, filters and/or overload devices associated therewith. Electrical power from an external source, such as a receptacle disposed adjacent the floor, can be fed by a cable which extends upwardly through the end of the tray for connection to the power block. Electrical equipment on the work surface can be readily plugged into the receptacles on the power block by opening the appropriate doors, with the doors thereafter being closed while permitting the cables to extend through the access opening which extends along the free edge of the doors. The modular tray employing the power block also has a further channel-like tray fixedly secured to and projecting downwardly therefrom, with this further channel-like tray being usable for storing excess cable therein.

Figure 1:
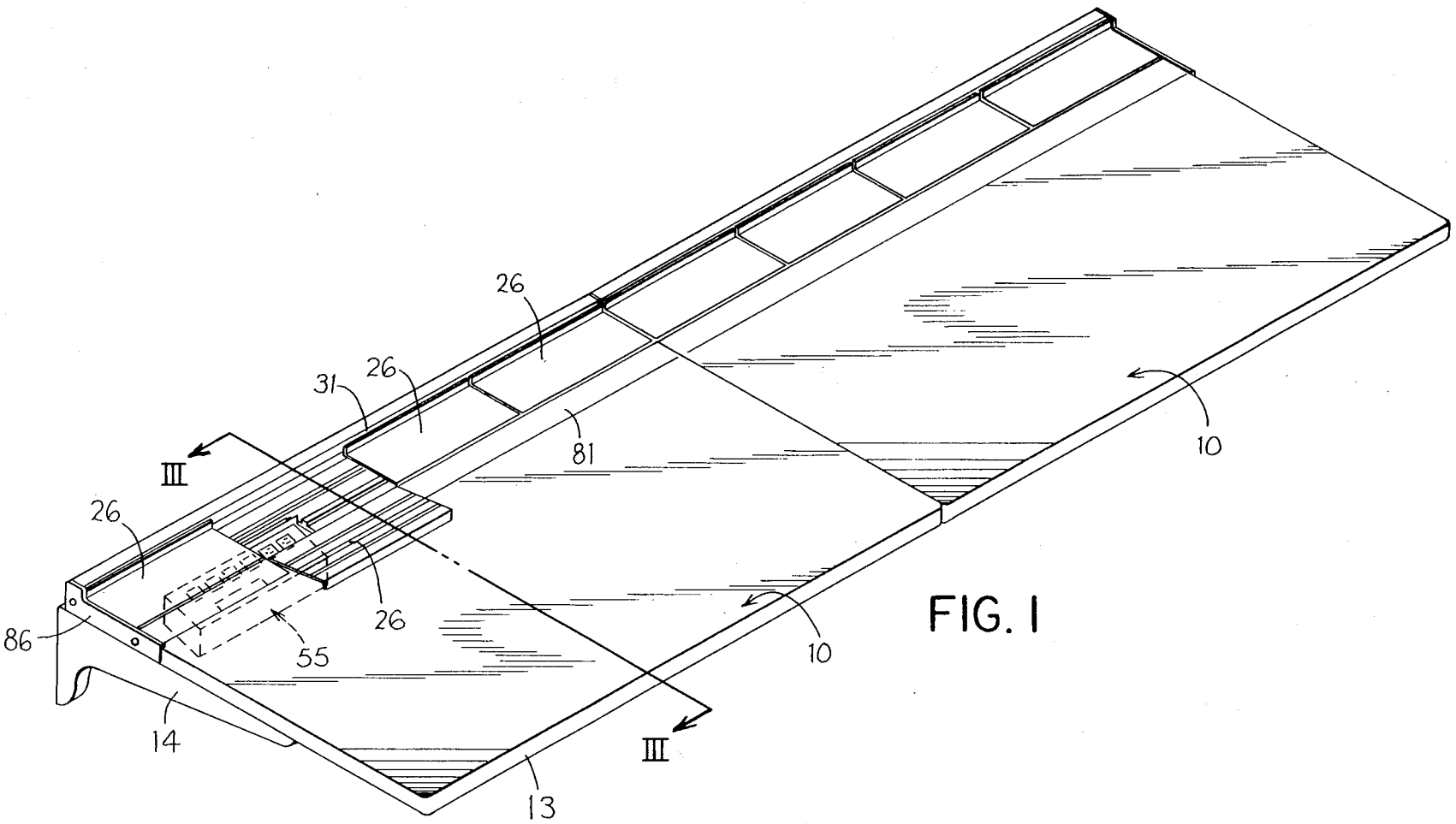
FIG. 1 is a perspective view which illustrates two work surface arrangements according to the present invention disposed in side-by-side relationship, the work surface arrangements being of the type which mount on brackets for securement to a vertical wall panel.
Figure 2:
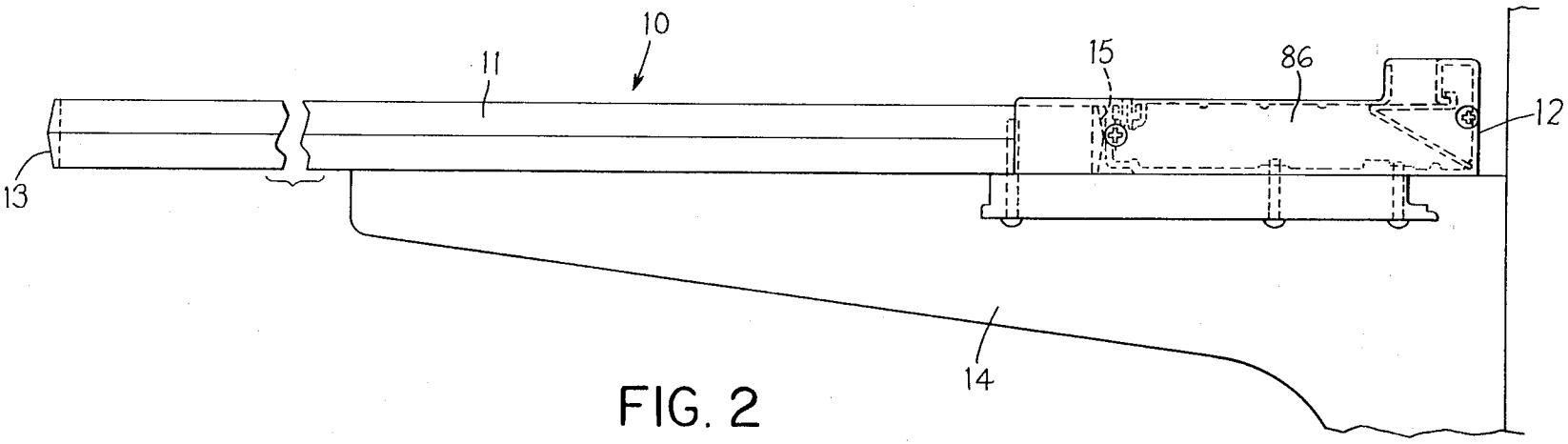
FIG. 2 is a fragmentary side view illustrating the work surface arrangement mounted on the bracket which secures it to a vertical wall panel.

In the following description, certain terms will be used for convenience in reference only. For example, the words "upwardly", "downwardly", "rightwardly" and "leftwardly" will refer to directions in the drawings to which reference is made. The word "rear" will refer to the edge of the work surface arrangement which is adjacent the wall panel, namely the rightward side as appearing in FIGS. 2 and 3. The words "inwardly" and "outwardly" will refer to directions toward and away from, respectively, the geometric center of the work surface arrangement and designated parts thereof. Said terminology will include the words specifically mentioned, derivatives thereof, and words of similar import.

DETAILED DESCRIPTION

The drawings illustrate a work surface structure 10 according to the invention. This structure includes a flat sheetlike top member 11 which defines a horizontally enlarged planar upper working surface. This work surface structure 10 has substantially parallel rear and front edges 12 and 13 and, in the illustrated embodiment, the structure 10 is adapted to be supported on brackets or arms 14 which secure to vertical posts associated with a vertical wall panel in a conventional manner, one example of such structure being illustrated by U.S. Pat. No. 4,198,913.

In the improved arrangement of the present invention, the work surface structure 10 has an elongated channel arrangement 16 fixedly secured to and extending longitudinally along the rear edge 12 thereof for accommodating electrical and/or communication cabling. This channel arrangement 16 includes a shallow upwardly opening channel member 17 having a bottom wall 18 and a pair of upwardly projecting sidewalls 21 and 22 so that the channel arrangement 16 extends longitudinally throughout the complete length of the work surface structure 10. This channel 17 does not have a top wall and hence defines a top opening 23 for providing access into the interior space 24 defined within the channel. This top opening 23 is at least partially closed by a plurality of doors or covers 26, the illustrated embodiment having four such covers 26 disposed in side-by-side relationship. Each of these covers 26 is connected at its frontward edge by a molded plastic hinge 25 to the channel sidewall 21 adjacent the upper end thereof, whereby the cover 26 has a hinge which is close to the upper surface 11 so that the cover 26 can be swung upwardly and forwardly into an open position wherein it lays back over the surface 11, as appearing in FIG. 3. This provides access to the channel space 24 through the full width of the top opening 23. Cover 26, however, can be swung into a closed position wherein it extends substantially across the top opening 23 and is substantially coplanar with the top surface 11. When in this closed position, the cover 26, adjacent the free edge thereof, bears on a pair of fixed stops 27 which engage the cover adjacent the opposite ends thereof.

When the cover or covers 26 are in the closed position, the covers have upwardly projecting tabs 28 adjacent the free ends thereof, and these tabs are spaced forwardly from an opposed flange or wall 29 formed on the rear sidewall of the channel member 17. These walls 28 and 29 are spaced apart by an access opening 31 which is relatively narrow, such as ½" to 1" in width. This access opening 31 extends the full longitudinal length of the channel arrangement and provides continuous communication to the space 24 to permit communication and/or electrical power cables to project outwardly therethrough for connection to equipment located on the work surface, even when the covers are closed.

The bottom wall 18 of channel 17 has a pair of openings 33 and 34 extending therethrough, these openings being elongated in the lengthwise direction of the channel arrangement and spaced apart so that the bottom wall 18 defines bridge portions 36 which either separate the openings from one another or from the adjacent end of the channel. Each of these openings 33 and 34 is adapted to have a suitable tray module positioned therein depending upon the desired mode of use.

Figure 4:
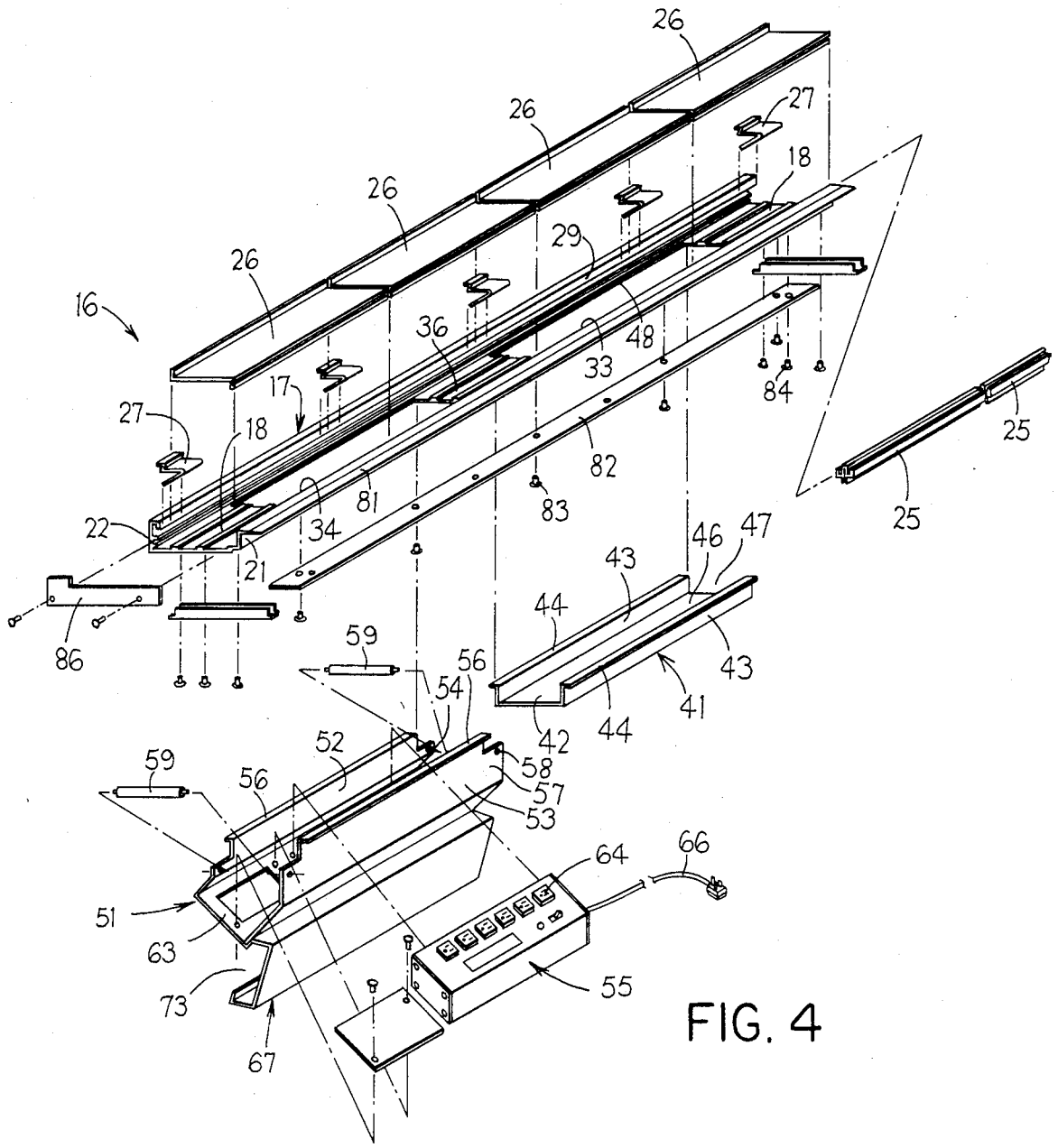
FIG. 4 is a perspective view which illustrates the power and communication channel arrangement in an exploded or separated condition.

For example, as illustrated by FIG. 4, the opening 33 supports therein an elongated tray module 41 which is of a generally channel-shaped configuration and includes a substantially planar bottom wall 42 joined to a pair of upwardly projecting sidewalls 43, the latter at their upper ends having outwardly projecting mounting flanges 44. This modular tray 41 defines an appropriate storage compartment 46 therein which is rather shallow, and the opposite ends of the tray are open as indicated at 47.

The tray 41 has a length which substantially corresponds to that of the opening 33, and the tray is positioned so as to be disposed within and project downwardly through the opening 33. That is, the width of the tray as defined between the outside surfaces of the sidewalls 43 corresponds to the width of the opening 33 so that the tray can be moved downwardly through the opening 33 so that the sidewalls 43 in effect define a snug fit with the side edges of the opening 33. The flanges 44 project outwardly and overlap the bottom wall 18 of the channel, with this bottom wall preferably being provided with elongated ribs 48 extending directly along the side edges of the opening for supporting the flanges 44 thereon, similar to the rib and flange arrangement as appearing in FIG. 3. With the modular tray 41 supported within the opening 33, the bottom wall 42 thereof is disposed downwardly a small distance from the channel bottom wall 18, and this increases the usable space of the channel arrangement when the covers are closed, thereby providing additional space for storage of excess cabling and the like.

Depending upon where the cables originate, the cables can pass outwardly through the open end 47 of the tray to project downwardly for connection to a communication point disposed near the floor.

The tray 41 can also be provided with other structure associated therewith to permit it to be utilized as a storage tray. For example, either a separate storage compartment can be supported within the tray, or the bottom wall of the tray itself can be provided with appropriate dividers extending upwardly therefrom and across the compartment 46 to function as storage compartments for different objects.

The tray 41, due to the manner in which it drops into the opening, can obviously be readily removed and interchanged as desired.

The other opening 34 can also be provided with a removable modular try 41 as described above.

Alternately, one of the openings, such as the opening 34 in the illustrated embodiment, can be provided with a tray module 51 which is designed specifically for accommodating an electrical power block 55 to permit numerous electrical power receptacles and the like to be provided substantially at work surface height.

The modular tray 51 is removably fitted within and is suspended downwardly through the opening 34 in substantially the same manner as the tray 41 described above. That is, tray 51 has substantially parallel sidewalls 52 and 53 which define an enlarged compartment 54 therebetween, which sidewalls at their upper ends terminate in outwardly projecting flanges 56. These sidewalls 52 and 53 are spaced apart by a distance which substantially corresponds to the width of opening 34 so that they will be snugly fitted between the opposite side edges of the opening 34, and the flanges 56 will project outwardly to overlap and be supported by the ribs or beads 48 which extend along the bottom wall adjacent the edges of the opening substantially as illustrated by FIG. 3.

As illustrated by FIG. 4, these opposed sidewalls 52 and 53 have a length which exceeds that of the opening 34 so that the sidewalls have parts designated 57 which project outwardly beneath the intermediate bridging portions 36. These parts 57, adjacent the corners thereof, have openings 58 which accommodate therein the ends of a spacer pin 59, the latter extending transversely across the tray 51 so that the reduced ends thereof are accommodated in the openings 58 to prevent the sidewalls from moving inwardly and hence effecting dislodgement of the tray from the opening.

The tray 51 has a substantially deep channel-shaped cross section such that the upwardly cantilevered sidewalls 52 and 53 have sufficient resilient flexibility to permit them to be deflected inwardly toward one another. The tray 51 is mounted on the channel 17 by positioning the tray beneath the opening 34. With the sidewalls 52 and 53 deflected inwardly toward one another, the tray 51 is moved upwardly until the flanges 56 pass through the opening 34, whereupon the sidewalls 52 and 53 are permitted to resiliently return outwardly away from one another and thereby cause the flanges 56 to overlap the ribs 48. After being so positioned, the spacer pins 59 are mounted in the opposed openings 58 to prevent the sidewalls from being moved inwardly and hence effect undesired dislodgement of the tray.

Figure 3:
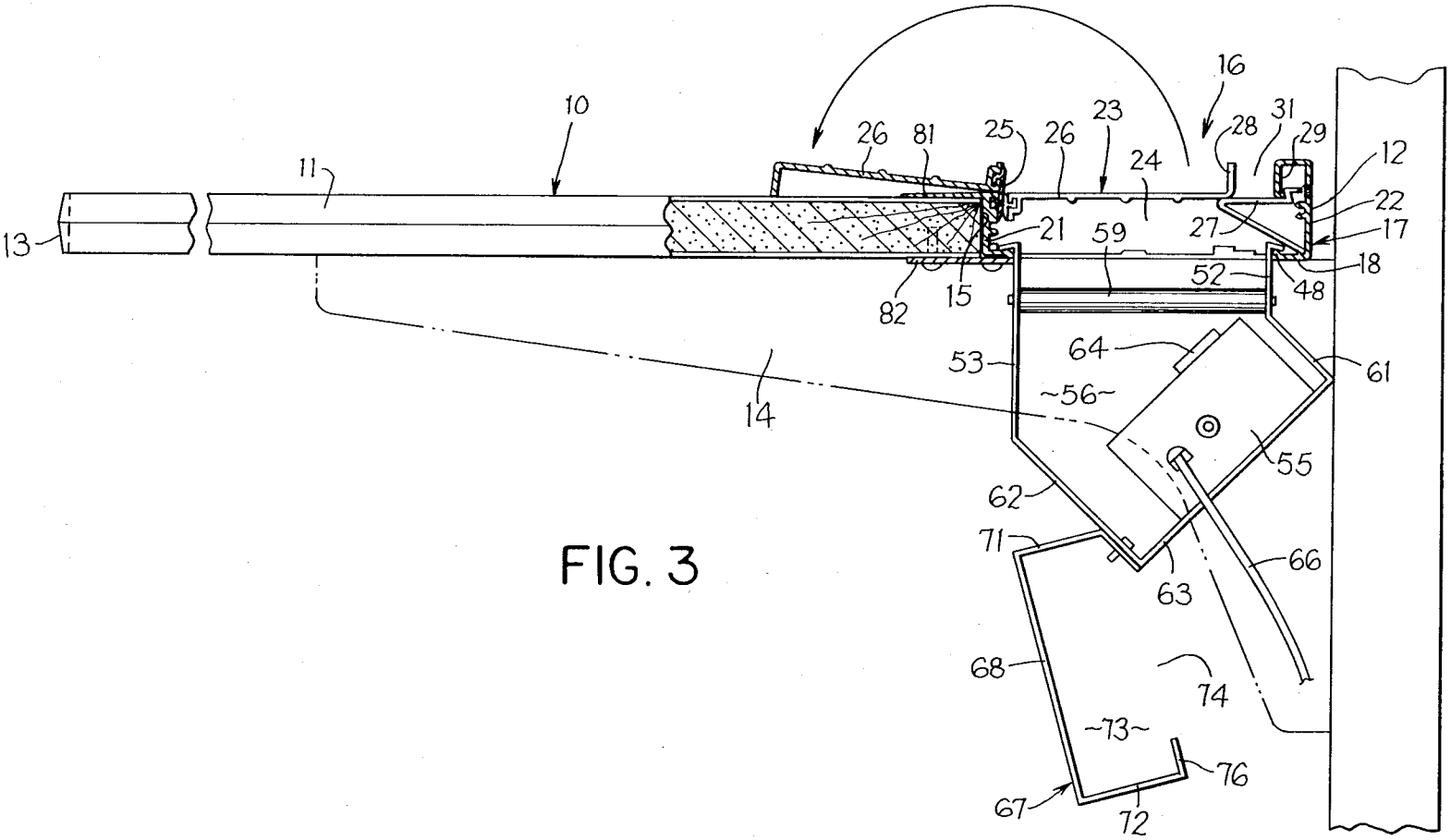
FIG. 3 is a partial sectional view as taken substantially along line III—III in FIG. 1.

As illustrated by FIGS. 3 and 4, the sidewalls 53 and 52 of the tray have respective lower wall portions 61 and 62 which slope downwardly and rearwardly to provide the interior channel space 54 with substantial depth. These wall portions 61–62 are appropriately joined by a bottom wall 63. This provides the channel space 54 with sufficient space to accommodate therein the power block 52, the latter being fixedly secured to this bottom wall 63 in the illustrated embodiment.

The power block 55 is of a conventional configuration and it includes a plurality for conventional three-hole electrical receptacles 64 accessible through an exposed sidewall of the housing thereof, the receptacles being appropriately internally wired within the housing of the power block through appropriate filters, surge protectors and overload devices, such being conventional. Power is supplied to the power block through a conventional power cord 66 which projects from one end and terminates in a conventional three-prong plug. This cord 66 can project outwardly through the open end of the tray 51 below the channel 17 to be fed downwardly for connection to an appropriate power receptacle disposed in the vicinity of the floor. Power units 55 are conventional and well known, and further description thereof is believed unnecessary.

While the illustrated tray module 51 mounts the power block 55 in the interior thereof, in some instances it may be desirable to fixedly secure the power unit to the external side of the tray so that the receptacles are accessible through an opening formed in the sidewall of the tray. Such an arrangement is illustrated in aforementioned U.S. Pat. No. 4,654,756, and it is contemplated that a similar mounting arrangement for the power block could be provided with respect to the modular tray 51 of this invention.

The modular tray 51 also has a cord or cable-holding tray 67 associated therewith. This latter comprises a channel-like member which is fixedly secured to and suspends downwardly from the tray 51, with this channel-like member 67 opening forwardly and having a length similar to that of the tray 51. Channel member 67 has a base leg 68 joined to top and bottom side legs 71 and 72, respectively. The top leg 71 is provided with an appropriate flange to permit it to be removably fixedly secured to the bottom of the tray 51, such as adjacent the lower edge of the wall 62. The channel member 67 defines therein a storage compartment 73 for excess cabling, this compartment 73 being accessible through an opening 74 which faces forwardly and extends throughout the length of the channel member. The lower leg 72 has a flange 76 projecting upwardly a small extent along the front edge thereof, thereby partially closing off the lower portion of storage compartment 73 to facilitate the confinement of cable therein. This compartment 73 can be readily accessible for storage of cable therein inasmuch as cable from the channel 54 of the tray 51 can be fed outwardly through either open end of the tray 51 and then looped downwardly to be appropriately coiled and stored within the compartment 73.

The channel arrangement 16 can, in its entirety, be readily fitted to virtually any type of work surface 11, whether of steel or particle board, and can also be readily retrofitted to existing such work surfaces. This is accomplished by the desirable structure of the channel arrangement 16 and the manner in which it secures to the edge 15.

For this purpose, the channel member 17 has, adjacent the upper edge of the front sidewall 21 thereof, a forwardly projecting mounting flange 81, which flange extends longitudinally throughout the complete length of the channel member and has a lower surface which is adapted to snugly overlie the upper surface of the work surface member 11. This flange 81 is formed integrally with the channel member 17, the latter preferably comprising a one-piece extruded member, such as an aluminum extrusion. A further platelike mounting flange 82 is adapted to be secured to the underside of the work surface 11 to effectively rigidly sandwich the edge portion of the work surface member between the flanges 81 and 82. This lower mounting flange 82 comprises an elongated platelike strip which extends throughout the complete length of the channel member, with this strip having one edge thereof disposed to project under and overlap the bottom wall 18 in the vicinity of the sidewall 21, with the lower mounting flange 82 being secured to the bottom wall 18 by a plurality of threaded fasteners or screws 83. In a similar fashion, a further plurality of threaded fasteners or screws 84 project upwardly through the flange 82 into the work surface 11 to rigidly and fixedly secure the channel arrangement 16 to the edge 12 of the work surface member 11. With this arrangement, the channel arrangement can be readily fitted, either in the factory or at the job site, to a preconstructed work surface member. Further, in situations where the work surface member is of a particle board material, a wide work surface member such as a 30″ width can be readily cut down, as by sawing, to a 24″ width and then have the channel arrangement 16 secured thereto. This channel arrangement 16 is preferably about 6″ in width, and this will again result in the creation of a work surface arrangement having an overall width of substantially 30″.

When the work surface arrangement 10 is positioned so as to define an exposed edge, the end of the channel 17 is appropriately closed by an end cap 86 which is secured in position by a pair of screws.

When the tray 51 and power block 55 are utilized, as appearing in FIG. 3, the storage compartment 54 defined within the interior of tray 51 provides substantial space for storage of cables and the like, particularly since this provides accessible space which projects downwardly around the power block 55 all the way to the lower or bottom wall 63 thereof. The cables can be stored in the bottom portion of this space 54 directly adjacent the side of the power block, and hence not interfere with access to the receptacles 64.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a work surface structure having a horizontally enlarged top member with an enlarged and substantially planar upper working surface, the top member being of substantially rectangular configuration and including longitudinally extending front and rear edges, the improvement comprising:

channel means fixedly secured to and extending longitudinally along said rear edge for defining an elongated channel-like space for cables or conduits, said channel means including a longitudinally elongated channel-like member having a bottom wall, and openable cover means associated with said channel-like member and being pivotally mounted relative thereto for swinging movement between open and closed positions, said cover means when in said closed position extending across and substantially closing off the upper side of said channel member and being approximately flush with the upper working surface;

said bottom wall of said channel-like member having first and second openings extending therethrough, said openings being spaced apart from one another and individually elongated in the longitudinal direction of said channel-like member;

first and second removable, longitudinally elongated tray modules respectively positioned within said first and second openings and removably supported on the bottom wall of said channel-like member, said first and second tray modules substantially occupying said first and second openings and having side flanges which upwardly overlap said bottom wall adjacent the sides of said openings for permitting the tray modules to be removably supported on the bottom wall when occupying said first and second openings.

2. A structure according to claim 1, wherein said first tray module has a shallow channel-shaped cross section defined by a bottom wall and a pair of upwardly projecting sidewalls which terminate in said side flanges which project over and are supportingly engaged on the bottom wall of the channel-like member, the bottom wall of said first tray module being substantially parallel with but spaced downwardly a small distance from the bottom wall of said channel-like member.

3. A structure according to claim 1, wherein said first tray module is of a shallow channel-shaped cross section for permitting storage of cables therein, and wherein said second tray module is of a deep channel-shaped cross section, said second tray module mounting therein on a wall thereof an electrical power block which defines thereon a plurality of conventional receptacles.

4. A structure according to claim 3, wherein said channel-like member is of shallow depth in that the channel-like member has a depth which is similar to the depth of the top member, and said first and second tray modules projecting downwardly beyond the bottom wall of said channel-like member.

5. A structure according to claim 1, wherein said cover means is hinged adjacent its forward edge so that the cover means swings backwardly toward the front edge of said top member when opened, said cover means when closed having a width less than the width of the channel-like space to define a continuously open elongated access opening extending along the free edge of the cover means for permitting cables to extend therethrough.

6. A structure according to claim 1, wherein said channel-like member includes a top mounting flange which extends longitudinally along the upper edge of one sidewall and projects forwardly outwardly to overlap the working surface of said top member, said channel means including a lower longitudinally elongated platelike mounting flange which extends substantially parallel to said top flange and overlaps a lower surface of said top member adjacent the rear edge thereof, said lower mounting flange being fixedly secured longitudinally to said top member and said channel-like member so that said top member in the vicinity of the rear edge thereof is rigidly sandwiched between said top and lower flanges.

7. A work surface structure having a horizontally extending platelike top member with a substantially planar upper working surface, the top member being of substantially rectangular configuration and including front and rear edges and a pair of end edges extending therebetween, comprising:

a power module means secured to said top member adjacent to and extending longitudinally along said rear edge for providing electrical power for electrical equipment adapted to be supported on said top member;

an upwardly-oriented access opening associated with said power module means, said access opening being adjacent said rear edge and horizontally elongated generally parallel therewith;

said module means including a housing which is secured to and projects downwardly from said top member and defines therein a main compartment which is disposed below and accessible through said access opening, said housing being horizontally elongated generally parallel with said rear edge;

a rear flange extending longitudinally along the rear edge of said access opening and being fixedly related relative to the top member;

cover means pivotally supported by a hinge for movement relative to said top member between (1) a closed position wherein it closes off said access opening and is substantially flush with said upper working surface and (2) an open position wherein said access opening is exposed;

said cover means being hinged relative to the top member along a longitudinally extending front edge of the cover means so that the cover means swings upwardly and forwardly about the hinge when being moved into the open position, said cover means when in the open position overlapping a part of the upper working surface, said cover means having a longitudinally extending free edge which is disposed adjacent but spaced slightly forwardly from said rear flange when said cover means is closed so as to define between said free edge and said rear flange a narrow longitudinally extending slot which communicates with said main compartment for permitting cables to pass therethrough;

said module means including an electrical power unit removably secured to said housing and having a wall which mounts thereon a plurality of electrical receptacles, said wall and the electrical receptacles thereon being accessible solely from said main compartment, said wall being spaced downwardly from said cover means and being sloped upwardly as it projects rearwardly so as to face both upwardly and forwardly for increased accessibilty and visibility of the receptacles mounted thereon when the cover means is in its open position; and said main compartment as defined within said housing defining an open space in front of said wall and extending downwardly below said receptacles for storing cables therein.

8. A structure according to claim 7, wherein the housing defines an elongated channel which extends longitudinally along the rear edge of said top member throughout the full longitudinal extent thereof, said channel including a secondary storage compartment therein which is disposed longitudinally adjacent said main compartment.

9. A structure according to claim 7, wherein said cover means includes a plurality of individual covers which are disposed in side-by-side relationship longitudinally along said access opening, said covers being individually pivotally movable between open and closed positions about a common hinge axis.

10. A work surface structure having longitudinally extending front and rear edges joined together by side edges, said structure including a top member which defines thereon a substantially planar upper working surface, comprising:

a power module means secured to said top member and extending longitudinally along said rear edge for providing electrical power for electrical equipment adapted to be supported on said top member;

said power module means including an elongated channel-like housing which is fixed relative to said top member and extends longitudinally along and directly adjacent said rear edge, said channel-like housing opening downwardly from said upper working surface and defining therein an interior compartment, said channel-like housing also having in the upper extremity thereof an upwardly-oriented access opening disposed substantially within the plane of said upper working surface;

manually movable cover means pivotally supported relative to said top member for movement between (1) a closed position wherein it substantially closes off said access opening and is substantially flush with said upper working surface and (2) an open position wherein the access opening is exposed, said cover means being connected by a hinge along its longitudinally extending front edge relative to said top member so that the cover means is swung upwardly and forwardly to overlap the upper working surface when the cover means is moved into its open position, said cover means when in said closed position being disposed with its free edge disposed rearwardly from said hinge in close proximity to said rear edge, the free edge of said cover means when in said closed position cooperating with said access opening to define a narrow longitudinally extending slot which is disposed closely adjacent said rear edge and permits cables to project through said slot into said compartment;

said module means including an electrical power unit removably secured to said housing and having a wall which mounts thereon a plurality of electrical receptacles, said wall and the electrical receptacles thereon being accessible solely from said compartment, said wall being spaced downwardly from said cover means, said compartment including a space therein disposed below said cover means for permitting storage of cable.

11. A structure according to claim 10, wherein said cover means includes a plurality of individually swingable cover members arranged longitudinally along said access opening in side-by-side relationship.

* * * * *